US009961462B2

(12) United States Patent
Gaiser et al.

(10) Patent No.: US 9,961,462 B2
(45) Date of Patent: May 1, 2018

(54) METHOD AND SYSTEM FOR CHECKING AN ACOUSTIC TRANSDUCER

(71) Applicant: KONINKLIJKE PHILIPS N.V., Eindhoven (NL)

(72) Inventors: Yvonne Gaiser, Stuttgart (DE); Kurt Bauer, Dettenhausen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 47 days.

(21) Appl. No.: 14/388,392

(22) PCT Filed: Apr. 2, 2013

(86) PCT No.: PCT/IB2013/052630
§ 371 (c)(1),
(2) Date: Sep. 26, 2014

(87) PCT Pub. No.: WO2013/153484
PCT Pub. Date: Oct. 17, 2013

(65) Prior Publication Data
US 2015/0086028 A1 Mar. 26, 2015

Related U.S. Application Data

(60) Provisional application No. 61/622,124, filed on Apr. 10, 2012.

(51) Int. Cl.
*H04R 29/00* (2006.01)

(52) U.S. Cl.
CPC ..... *H04R 29/001* (2013.01)

(58) Field of Classification Search
CPC .... H04R 29/00; H04R 29/001; H04R 29/002; H04R 29/007; H04R 27/00;
(Continued)

(56) References Cited

U.S. PATENT DOCUMENTS 5,103,214 A * 4/1992 Curran ..... G08B 29/10 340/292
5,345,510 A 9/1994 Singhi et al.
(Continued)

FOREIGN PATENT DOCUMENTS

EP 2229006 A1 * 9/2010 ..... H04R 29/001
JP 02039712 A * 2/1990
JP 2007033288 2/2007

OTHER PUBLICATIONS

Lin, M-C., et al.; FPGA-based Spectrum Analyzer with High Area Efficiency by Goertzel Algorithm; 2008; Congress on Image and Signal Processing; pp. 157-159.
(Continued)

*Primary Examiner* — Leshui Zhang

(57) ABSTRACT

An acoustic transducer and audio system are checked for operability continuously during operation without interfering with their operation. An inaudible test signal is added on top of a normal audio signal of an electronic device. A mix of the test signal and the normal audio signal is converted to a digital signal which is processed by a type of Fourier transformation, e.g. the Goertzel algorithm, to derive the magnitude of the digital signal at the test signal frequency. The derived magnitude is used to gain knowledge about the functionality of the acoustic transducer and its electrical connection to the electric device, as well as a common audio path.

17 Claims, 2 Drawing Sheets

(58) Field of Classification Search
CPC ..... H04R 2205/024; H04R 2400/01; H04R 2420/05; H04R 3/00; H04R 3/007; H04R 3/12; H04R 5/04; H04R 29/004; H04R 3/002; H04R 29/003; H04S 7/301; H04S 3/00; H04M 3/10; H04M 3/24; H04M 3/28; H04M 9/00; H04B 3/46; G01B 31/026; H03F 1/52; H03F 2200/331; H03F 1/30; H03F 2200/03; H03G 11/00; H03G 11/008; H03G 11/02; H03G 11/04
USPC ..... 381/55, 82, 84, 77, 86, 314, 300, 302, 381/304, 303, 307, 56–60, 306; 340/514, 340/515, 518, 522, 539, 506, 508, 509, 340/635, 650, 651, 692, 823.06, 825.16, 340/825.24, 825.25, 384 R, 384 E, 405; 330/10, 207 P, 298; 327/124, 127; 700/94
See application file for complete search history.

(56) References Cited

U.S. PATENT DOCUMENTS

| | | | | |
|---|---|---|---|---|
| 5,492,129 | A * | 2/1996 | Greenberger ..... | A61B 7/04 181/131 |
| 7,813,514 | B2 | 10/2010 | Asada | |
| 7,864,631 | B2 | 1/2011 | van Leest et al. | |
| 2005/0207585 | A1 * | 9/2005 | Christoph ..... | G10K 11/1788 381/71.11 |

OTHER PUBLICATIONS

Texas Instruments; LM48100Q Boomer; 2008; Product Catalogue; http://www.ti.com.
Bonnie Baker, "Anti-Aliasing, Analog Filters for Data Acquisition Systems", 1999 Microchip Technology Inc.

* cited by examiner

METHOD AND SYSTEM FOR CHECKING AN ACOUSTIC TRANSDUCER

CROSS REFERENCE TO RELATED APPLICATIONS

This application is a national filing of PCT application Serial No. PCT/IB2013/052630, filed Apr. 2, 2013, published as WO 2013/153484 A1 on Oct. 17, 2013, which claims the benefit of U.S. provisional application Ser. No. 61/622,124 filed Apr. 10, 2012, which is incorporated herein by reference.

FIELD OF THE INVENTION

The invention relates to a method and a system for checking operability of an audio output system, in particular an acoustic transducer, e.g. a speaker of an electronic device.

BACKGROUND OF THE INVENTION

Permanent testing of acoustic transducers, such as speakers, during normal operation faces several problems. Especially in medical devices (e.g. a portable or a stationary patient monitors) with their alarming function, the audio output of such medical devices must not be influenced or even stopped while testing the functionality of an incorporated speaker. It is desirable that audio signals (e.g. alarm tones) are not delayed or corrupted by the test. False test results of a speaker check caused by normal audio output must be prevented. Moreover, due to the operational area of medical devices, any disturbing noise audible to a patient is not acceptable and should be prevented.

An integrated circuit (LM48100Q, http://www.ti.com/product/lm48100q) has been proposed, that provides a combination of a power amplifier and a corresponding test circuit. The integrated circuit is adapted to sense the load condition as well as detecting open circuit conditions. However, the test is only possible when no other audio signal (e.g. coming from a medical device) is present at the speaker. It even stops current audio output and produces audible noise while testing.

SUMMARY OF THE INVENTION

An object of the present invention is to provide a method and system for checking operability of a speaker or other type of acoustic transducer and its corresponding audio output system by means of which it can be assured that audio signals are not delayed or corrupted by the test and no disturbing noise is generated.

Accordingly, the proposed checking system and method is adapted to add an inaudible test signal on top of the normal audio signal, so that the signal mix consisting of the test signal and the normal audio signal can be derived and filtered and used for a frequency analysis processing to obtain a magnitude of the signal at the test signal frequency. This magnitude can be used to gain knowledge about the functionality of the acoustic transducer and its electrical connection to the host device as well as the audio output system consisiting of e.g. I2S interface, digital audio path, digital-to-analog converter (DAC), amplifier and so forth. Thereby, the normal audio signal is not influenced and the environment is not disturbed by the inaudible test signal.

According to a first aspect, the measuring circuit may be adapted to measure an alternating current in a signal path of the acoustic transducer. This allows easy measurement of the test signal in the circuit of the acoustic transducer, e.g., by a shunt resistor. Alternatively, the acoustic output may be measured by other means e.g. with a microphone or an optical sensor or indirectly by measuring the supply current of the audio amplifier.

According to a second aspect which can be combined with the above first aspect, the frequency analyzer may be adapted to derive the magnitude of the digital signal at the test signal frequency by applying a type of Fourier analysis. The Fourier analysis allows extraction of magnitudes of frequencies included in the measured signal mix, so that the magnitude at test signal frequency may easily be derived, as long as the test signal frequency does not fall in the frequency range of the normal audio signal. In a more specific example, the frequency analyzer may be adapted to derive the magnitude at the test signal frequency by applying the Goertzel algorithm. While the general Fourier transform algorithm computes evenly across the bandwidth of the signal to be analyzed, the Goertzel algorithm is adapted to look at specific, predetermined frequencies while ignoring all other frequencies. Thereby, a considerable amount of software or processing resources can be freed.

According to a third aspect which can be combined with the above first or second aspect, the test signal generator may be adapted to add the test signal continuously during operation of the acoustic transducer. Continuous or permanent addition of the test signal provides the advantage that failures of the acoustic transducer or other parts of the audio path are detected contemporary and possibly audible switching of the test signal is prevented.

According to a fourth aspect which can be combined with any of the above first to third aspects, the measuring circuit may comprise an analog filter for filtering the signal mix. Such a filtering provides the advantage that a test signal with small signal amplitude can be amplified and aliasing frequencies and audio signals are suppressed before being converted and processed in the digital domain.

According to a fifth aspect, which can be combined with any of the above first to fourth aspects, the frequency analyzer may be adapted to apply a high pass and window function to the digital signal. This improves the performance of the frequency analysis.

According to a sixth aspect which can be combined with any of the above first to fifth aspects, the evaluator may be adapted to derive an impedance of the acoustic transducer from the magnitude. In a specific example, the evaluator may be adapted to compare the derived impedance with a minimum value and a maximum value to decide whether the acoustic transducer is disconnected, shortened or normally operating or if the audio system e.g. DAC, amplifier has a malfunction. Thereby, the decision as to the functionality of the acoustic transducer and the audio circuit can simply be derived from the impedance of the acoustic transducer, e.g., so as to decide whether the transducer is disconnected, shortened or normally operating.

The proposed checking scheme may be implemented at least partially as a computer program product stored on a computer-readable medium or downloaded from a network, which comprises code means for producing at least the deriving and deciding steps of method claim 12 when run on a computing device.

Further advantageous embodiments are defined below.

BRIEF DESCRIPTION OF THE DRAWINGS

These and other aspects of the invention will be apparent from and elucidated with reference to the embodiments described hereinafter.

The invention will now be described, by way of example, based on embodiments with reference to the accompanying drawings.

In the drawings:

FIG. 1 shows a flow diagram of a checking procedure according to a first embodiment;

FIG. 2 shows a schematic block diagram of a checking device or system according to a second embodiment; and FIG. 3 shows an overview of an exemplary implementation of the checking system according to a third embodiment.

DETAILED DESCRIPTION OF EMBODIMENTS

Various embodiments of the invention will now be described based on a checking or test system of an audio output system, especially a speaker of a medical device. In the embodiments, the speaker check is implemented in such a manner that the connection of the speaker to the medical device and speaker functionality and other parts of the audio system e.g. DAC, I2S interface are observed permanently during normal operation of the medical device. The audio output of the medical device is affected negligibly.

Figure 1:
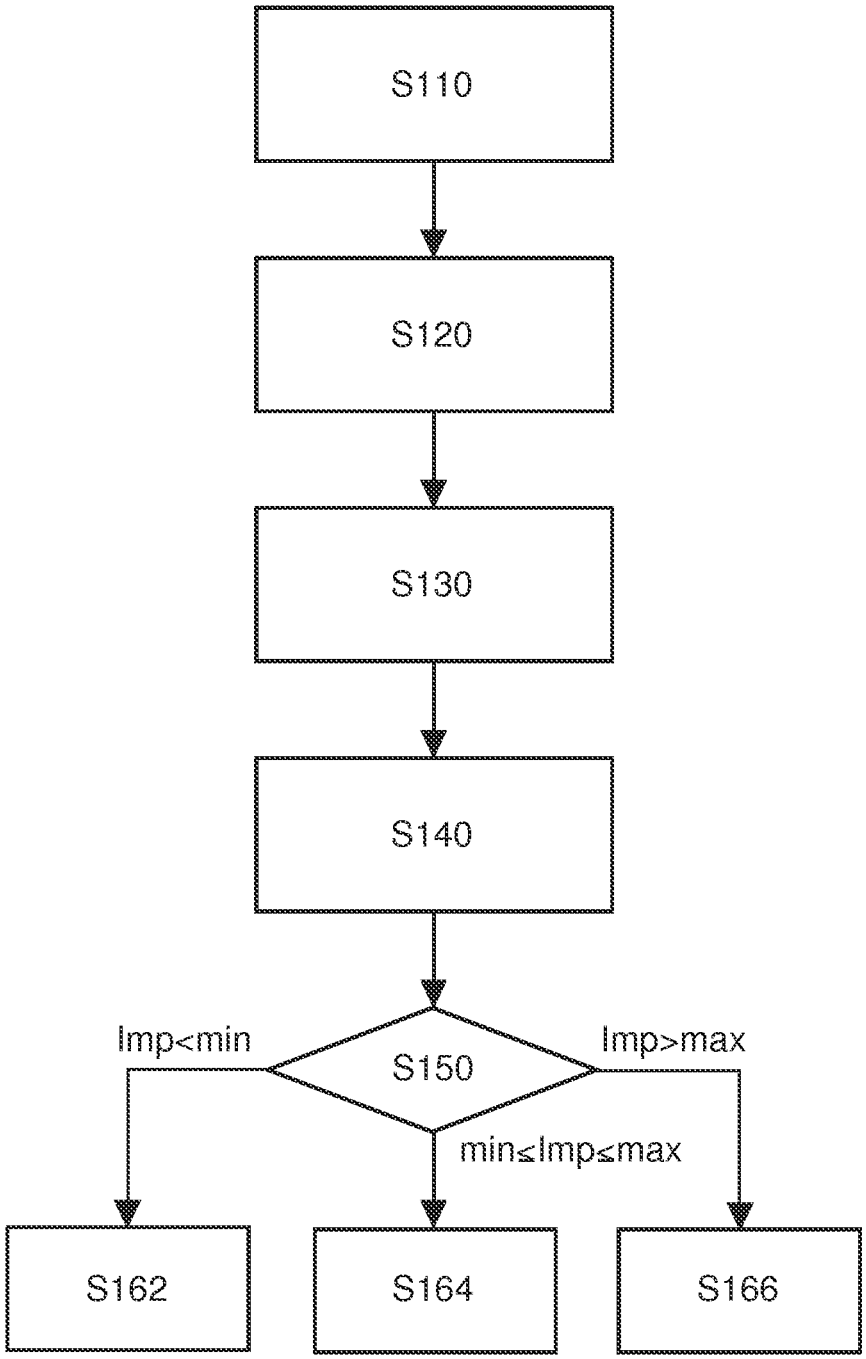

FIG. 1 shows a flow diagram of a speaker test or audio system checking procedure according to a first embodiment. In step S110, an inaudible permanent test signal is added on top of the normal audio signal of the medical device. Then, in step S120 the alternating current (AC) in the speaker path is measured by deriving and filtering the signal mix consisting of the test signal and the normal audio signal. Then, in step S130, the measured analog signal is converted to a digital signal. In the following step S140, the magnitude of the digital signal at test signal frequency is derived by using the Goertzel algorithm. All other signal parts are ignored by this algorithm. The obtained magnitude is then used in step S150 to decide about the speaker functionality and its electrical connection to the medical device and the functionality of other parts of the audio output system. To achieve this, an impedance is calculated based on the obtained magnitude and is compared with a minimum and maximum resistance value (e.g. 10Ω and 150Ω) to decide about the functionality of the speaker and the audio system. If it is determined in step S150 that the impedance is smaller than the above minimum value, the procedure branches to step S162 and indicates an error message or warning that the speaker may be short-circuited. Otherwise, if it is determined in step S150 that the value of the impedance is within the range between the above minimum value and the above maximum value, the procedure branches to step S164 where normal operation of the speaker and other parts of the audio output system is signaled. Finally, if it is determined in step S150 that the value of the impedance is larger than the above maximum value, the procedure branches to step S166 where a warning or indication is issued that the speaker may be disconnected from the system or e.g. the amplifier has a malfunction.

Thus, the magnitude of the test signal (i.e., the magnitude of the extracted digital signal at test signal frequency) is used to gain knowledge about the speaker functionality and its electrical connection to the medical device and the functionality of other parts of the audio output system. The Goertzel algorithm is a variation of a discrete Fourier transformation (DFT). By using the Goertzel algorithm instead of a DFT or even a fast Fourier transformation (FFT) a considerable amount of processing resources can be saved or freed for other purposes. Of course, the determination of the magnitude at test signal frequency in step S140 may be performed by DFT, FFT or other frequency analyzing algorithms or mechanisms.

The speaker checking or test system can measure the impedance of the speaker or loudspeaker during normal operation so as to verify that the speaker is connected and functioning as well as to verify the functionality of audio output system. This allows to detect the cases that no loudspeaker is attached (e.g. impedance >125Ω) or that the loudspeaker inputs are shorted together (e.g. impedance <10Ω). Of course, other minimum and maximum impedance values can be used for the decision or other situation could be signaled based on the determined magnitude.

Figure 2:
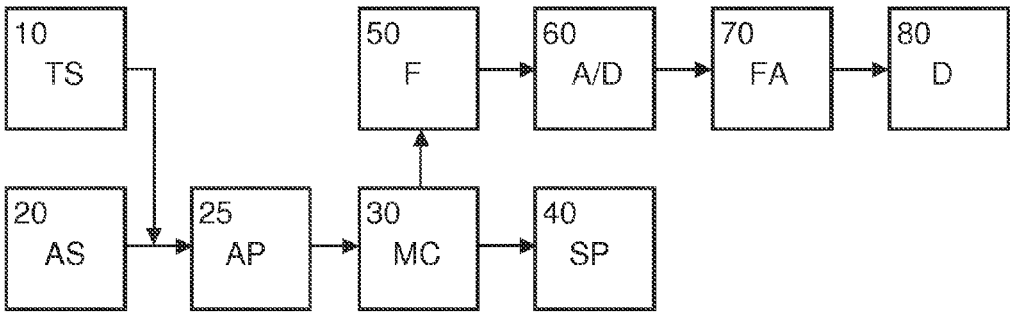

FIG. 2 shows a schematic block diagram of a speaker test or audio checking system or device according to second embodiment.

During normal operation, a test signal generator (TS) 10 which may be implemented by a central processing unit (CPU) always outputs a test signal (e.g. a 4 Hz or 25 kHz sinusoidal signal at 50 $mV_P$). Since the frequency of the test signal is in the inaudible range, it is not audible for a human being. Furthermore, generation of the test signal is turned on with the checking system or monitor and will be turned off when the checking system or monitor is turned off. Thereby, any disturbance by the switching of the test signal can be prevented and permanent testing is possible. The normal audio signal is generated from an audio source (AS) 20 which may be part of the medical device which uses the common audio path (AP) 25 and a speaker (SP) 40 as an audio output. If an audio signal is generated by the audio source 20, the test signal will be added to this audio signal. The test signal has a small amplitude so that influence on the regular audio operation can be kept small.

Furthermore, a measuring circuit (MC) 30 is provided for measuring the test signal in the speaker path circuit. Thereby, the common audio path 25, e.g., digital-to-analog converter, power amplifier and the like between the audio source 20 and the speaker 40, can be tested.

The signal mix comprising the test signal and possibly an audio signal, as measured by the measuring circuit 30, is passed through an analog filter (F) 50. Thereby, aliasing frequencies and actual audio signals can be suppressed as much as possible and the test signal can be amplified before being digitalized at an analog-to-digital converter (A/D) 60 and processed by a frequency analyzer (FA) 70 to obtain a signal magnitude at test signal frequency, which is supplied to a decision circuit or function (D) 80 adapted to decide on the functionality of the speaker 40 and the common audio path 25. At least the frequency analyzer 70 and the decision function 80 may be implemented by a microprocessor, e.g., as software routines. The frequency analyzer 70 filters the digital data from the analog-to-digital converter 60 with a high pass and window function and performs a Goertzel algorithm. The Goertzel algorithm is adapted to determine the magnitude at the test signals frequency ignoring all other frequencies. Based on the obtained magnitude, the signal power and thus the-impedance of the speaker 40 can be derived. If the decision function 80 decides that the impedance is out of an allowable range, further actions can be initialized, e.g. by the microprocessor, to indicate a malfunction of the audio system.

The measuring circuit 30 may be implemented by using a differential amplifier which is adapted to measure the voltage across a shunt resistor (e.g. 1Ω resistor) connected across its input terminals. The low pass filter 50 may be implemented as a so-called Sullen-Key structure. Thereby, aliasing frequencies and actual audio signals can be suppressed and the test signal can be amplified.

The shunt resistor of the measuring circuit 30 can be placed in the path of the speaker 40.

Figure 3:
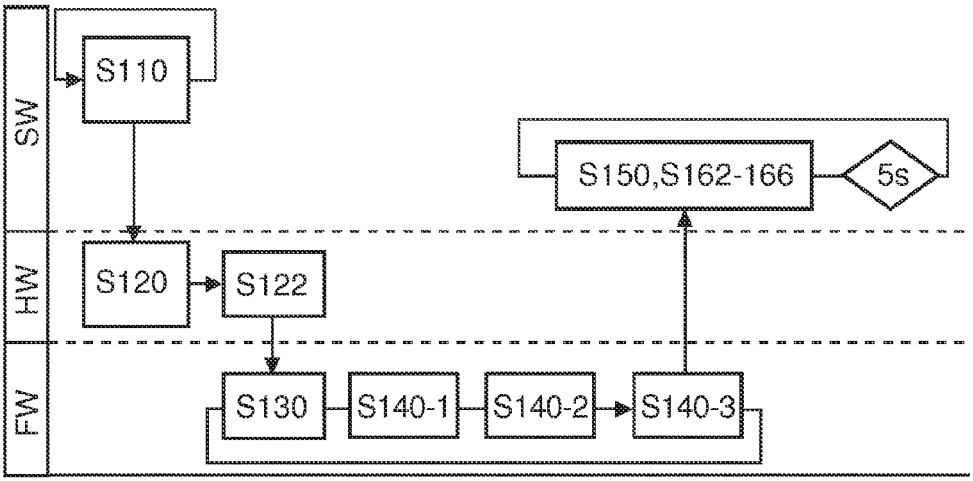

FIG. 3 shows an example of an implementation of the proposed speaker and audio output test system based on a combination of firmware (FW), hardware (HW) and software (SW), wherein firmware denotes fixed or semi-fixed data in a hardware device. This may include read only memory (ROM) and/or programmable logic array (PLA) structures for microcode and other data in a processor implementation, as well as the low-level machine code stored in ROM or flash memory running on the processor. It may also include microcode and other data in an application-specific integrated circuit (ASIC), or programmable logic devices which may have configuration data stored either as internal fuses, in a ROM, or in a flash memory. As can be gathered from FIG. 3, step SI 10 of FIG. 1 which relates to the generation and adding of the test signal to the audio signal may be performed as software routine. The same applies to step S150, S162, S164, and S166 which relate to the interpretation of the magnitude obtained from the Goertzel algorithm and the initialization of further actions or no actions, wherein a measurement interval (e.g. 5s) can be set between successive interpretations and initializations. The step S120 which relates to the measurement of the audio signal and the test signal as well as an additional step SI 22 which relates to the filtering and amplifying of the test signal may be implemented as hardware circuits (e.g., differential amplifiers). Finally, the whole process which relates to the digital domain and processing of the Goertzel algorithm may be implemented as firmware. More specifically, this relates to step S130 (analog-to-digital conversion) and partial steps S140-1 (high pass filtering), step S 140-2 (window filtering with a digital filter) and step S 140-3 (application of the Goertzel algorithm).

In summary, the method and system for checking an audio system especially an acoustic transducer has been described, wherein an inaudible test signal is added on top of a normal audio signal of an electronic device. A signal mix consisting of the test signal and the normal audio signal is derived and converted to a digital signal which is processed by a type of Fourier transformation, e.g. the Goertzel algorithm, to derive the magnitude of the digital signal at the test signal frequency. The derived magnitude is used to gain knowledge about the functionality of the acoustic transducer and its electrical connection to the electric device as well as knowledge about the functionality of the common audio output path.

While the invention has been illustrated and described in detail in the drawings and the foregoing description, such illustration and description are to be considered illustrative or exemplary and not restrictive. The invention is not limited to the audio output system check, especially the speaker check embodiments for a medical device. The proposed testing or checking scheme can be used for any acoustic transducer. Instead of measuring the AC current at a shunt resistor, the acustic output could be measured by other means e.g. a microphone or a optical sensor could be used to gain the same knowledge of the speaker and audio system funcitonality. Moreover, the above embodiments are focused on the Goertzel algorithm. However, a similar system can be built with any digital frequency analyzer which could be based on DFT, FFT or other frequency analyzing schemes.

From reading the present disclosure, other modifications will be apparent to persons skilled in the art. Such modifications may involve other features which are already known in the art and which may be used instead of or in addition to features already described herein.

Variations to the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

The invention claimed is:

1. A medical device comprising:

a patient monitor including a speaker; and a system for checking operability of said speaker, said system comprising:

a) an inaudible test signal generator configured to generate an inaudible test signal and add said inaudible test signal to an audio signal and form a mixed signal including an inaudible test signal component of the said inaudible test signal and an audio signal component of said audio signal, the mixed signal being communicated along a common audio path including at least one of a digital-to-analog converter and a power amplifier to the speaker;

b) a measuring circuit configured to:

measure the mixed signal after passing through the at least one of the digital-to-analog converter and the power amplifier of the common audio path;

suppress the audio signal component and aliasing frequencies of said mixed signal after passing through the at least one of the digital-to-analog converter and the power amplifier of the common audio path; and amplify the inaudible test signal component of said mixed signal after passing through the at least one of the digital-to-analog converter and the power amplifier of the common audio path;

c) an analog-to-digital converter configured to convert the amplified inaudible test signal component amplified by the measuring circuit and suppressed audio signal component and aliasing frequencies of the mixed signal after passing through the measuring circuit into a digital signal;

d) a frequency analyzer configured to derive a magnitude of said digital signal at a frequency of said inaudible test signal; and e) an evaluator configured to determine a functionality of said speaker based on said derived magnitude;

wherein generation of the inaudible test signal is turned on with the patient monitor and is turned off when the patient monitor is turned off.

2. The medical device according to claim 1, wherein said frequency analyzer is configured to derive said magnitude of said digital signal by applying a type of Fourier analysis.

3. The medical device according to claim 1, wherein said frequency analyzer is configured to derive said magnitude by applying a Goertzel algorithm.

4. The medical device according to claim 1, wherein said measuring circuit comprises an analog filter configured to filter said mixed signal after passing through the at least one of the digital-to-analog converter and the power amplifier of the common audio path.

5. The medical device according to claim 1, wherein said frequency analyzer is configured to apply a high pass and window function to said digital signal.

6. The medical device according to claim 1, wherein said evaluator is configured to derive an impedance of said speaker from said magnitude of said digital signal.

7. The medical device according to claim 6, wherein said evaluator is configured to compare said derived impedance with a minimum value and a maximum value and based on the comparing decide whether said speaker is disconnected, shortened or normally operating.

8. The medical device according to claim 1, further including:

a shunt resistor connected with the common audio path adjacent said speaker.

9. A method of determine functionality of an acoustic transducer and the components belonging to a common audio output system including at least one of a digital-to-analog converter and a power amplifier, said method comprising:

a) adding an inaudible test signal to an audio signal to form a mixed signal, the mixed signal being supplied to said acoustic transducer;

b) analog filtering the mixed signal to suppress the audio signal and enhance the inaudible test signal;

c) converting the analog filtered mixed signal with the suppressed audio signal and the enhanced inaudible test signal into a digital signal;

d) deriving a magnitude of said digital signal at a frequency of said inaudible test signal; and e) determine a functionality of said acoustic transducer based on said derived magnitude;

wherein the inaudible test signal is turned on with the patient monitor and is turned off when the patient monitor is turned off.

10. The method according to claim 9, further comprising calculating based on said magnitude of said digital signal an impedance of said acoustic transducer and deciding about said functionality by comparing said impedance with at least one predetermined range.

11. A non-transitory computer-readable medium carrying code for controlling a computer processor to perform at least said deriving and deciding steps according to claim 9.

12. The method according to claim 9, wherein said inaudible test signal generator is adapted to add said inaudible test signal to said audio signal continuously during operation of said acoustic transducer.

13. The method according to claim 9, wherein deciding about the functionality of the acoustic transducer includes classifying the acoustic transducer as disconnected, shorted, or operating normally.

14. A system for checking operability of an acoustic transducer which receives an audio signal from a common audio path including at least one of a digital-to-analog converter and a power amplifier, said system comprising:

a) an inaudible test signal generator configured to generate an inaudible test signal and add the inaudible test signal to an audio signal, the audio signal being on the common audio path;

b) an analog filter configured to receive the inaudible test signal and audio signal from the common audio path and suppress the audio signal; and c) an analog-to-digital converter configured to convert the suppressed audio signal suppressed by the analog filter into a digital signal;

d) one or more computing devices configured to:

determine a magnitude of the digital signal at a frequency of the inaudible test signal, and determine a functionality of the acoustic transducer based on the derived magnitude of said digital signal;

wherein the acoustic transducer, the common audio path, and the system for checking operability of the acoustic transducer are components of a patient monitor; and wherein the system for checking operability of the acoustic transducer is turned on when the patient monitor is turned on and turned off when the patient monitor is turned off.

15. The system according to claim 14, wherein said inaudible test signal generator adds said inaudible test signal to said audio signal continuously during operation of said acoustic transducer.

16. The system according to claim 14, wherein the one or more computing devices are configured to determine an impedance of said acoustic transducer based on the magnitude of said digital signal.

17. The system according to claim 14, wherein the one or more computing devices are configured to classify the acoustic transducer as disconnected, short, or normally operating based on the magnitude.

* * * * *